US008397655B2

(12) United States Patent
Braud et al.

(10) Patent No.: US 8,397,655 B2
(45) Date of Patent: Mar. 19, 2013

(54) DISCONNECTABLE TURRET MOORING SYSTEM WITH A ROTATABLE TURN TABLE

(75) Inventors: Jean Braud, La Turbie (FR); Jean Pierre Benoit, Cagnes-sur-Mer (FR); Cecile Melis, Nice (FR); Christian Bauduin, Eze Bord de Mer (FR)

(73) Assignee: Single Buoy Moorings Inc., Marly (CH)

( * ) Notice: Subject to any disclaimer, the term of this patent is extended or adjusted under 35 U.S.C. 154(b) by 208 days.

(21) Appl. No.: 12/993,481

(22) PCT Filed: May 19, 2009

(86) PCT No.: PCT/EP2009/056081

§ 371 (c)(1),
(2), (4) Date: Nov. 19, 2010

(87) PCT Pub. No.: WO2009/141351

PCT Pub. Date: Nov. 26, 2009

(65) Prior Publication Data

US 2011/0061582 A1 Mar. 17, 2011

(30) Foreign Application Priority Data

May 19, 2008 (EP) ..... 08156465

(51) Int. Cl.
*B63B 21/00* (2006.01)

(52) U.S. Cl. ..... 114/230.12

(58) Field of Classification Search ..... 114/230.1, 114/230.12, 230.13, 230.2, 293; 441/3–5; 29/428

See application file for complete search history.

(56) References Cited

U.S. PATENT DOCUMENTS

| | | | | |
|---|---|---|---|---|
| 5,316,509 | A * | 5/1994 | Boatman et al. | 441/3 |
| 5,651,708 | A | 7/1997 | Borseth | |
| 5,823,131 | A * | 10/1998 | Boatman et al. | 114/230.12 |
| 5,839,387 | A | 11/1998 | Myklebust | |
| 2003/0121465 | A1 | 7/2003 | Boatman et al. | |
| 2007/0155259 | A1 | 7/2007 | Van Tol et al. | |

OTHER PUBLICATIONS

International Search Report, dated Jun. 29, 2010, from corresponding PCT application.

* cited by examiner

*Primary Examiner* — Daniel Venne
(74) *Attorney, Agent, or Firm* — Young & Thompson

(57) ABSTRACT

A vessel includes a hull, a shaft extending from an upper part of the hull to a bottom of the hull, a turret being rotatably supported in the shaft via a turret bearing, a manifold support structure carrying one or more conduits being rotatably supported on the turret via a manifold bearing. The turret includes a cavity for receiving a mooring buoy carrying one or more risers and one or more vertically displaceable actuation members near the manifold bearing for vertically displacing the manifold support structure relative to the turret between a rotational position in which the manifold support structure can rotate relative to the turret via the manifold bearing and a locked position in which the bearing support structure is rotationally locked relative to the turret.

18 Claims, 7 Drawing Sheets

DISCONNECTABLE TURRET MOORING SYSTEM WITH A ROTATABLE TURN TABLE

FIELD OF THE INVENTION

The present invention relates to a disconnectable turret mooring system for a vessel. Such systems comprise a mooring buoy member and a turret structure mounted in a moonpool of the vessel, the mooring buoy member being anchored to the seabed with mooring lines and having a plurality of passages each adapted to receive a riser, the turret structure having a receptacle for receiving the buoy member and one or more locking devices for locking the buoy member in the receptacle, the turret structure accommodating a plurality of conduits to be connected to risers installed in passages of the buoy member, wherein the turret structure is rotatably supported in the moonpool of the vessel by means of at least one bearing assembly mounted above sea level.

BACKGROUND OF THE INVENTION

A disconnectable mooring system of this type is disclosed in US2007155259. This system includes a buoy member that is provided with a conical outer casing and a receptacle of the turret structure has a cone shape corresponding to the conical outer casing of the buoy member. The turret structure includes a turntable carrying conduits to be connected to the risers, wherein the turntable is supported on a bearing assembly in a manner allowing rotation with respect to the turret structure to align the conduits with the risers only after the buoy member is received and locked in the receptacle of the turret structure. In this patent publication it is shown that the turntable is supported by a main turret upper roller ball bearing assembly only. This bearing assembly includes three mutually movable parts that are directly interconnected to each other. In fact, this upper turret bearing assembly consists of 2 roller ball bearings that are directly placed on top of each other and interconnected via one common inner bearing housing member. This known upper bearing assembly has therefore become a critical and essential part of the turret-moored weathervaning system. A disadvantage of integrating the turret bearing and the manifold bearing into a single bearing structure is that if one or more roller balls fails, the complete bearing assembly has to be replaced, meaning that the turret system can no longer function as a weathervaning system. This replacement cannot be carried out under offshore conditions, so that the vessel needs to be transported to a on shore location for repair.

Another disadvantage of the known system is that the very heavy turntable with several manifold and swivels decks is at all times supported by this very sensitive rolling bearing assembly. Consequently all the large static and dynamic forces both in a radial and in an axial direction, and moments resulting form the turntable deck structure and the environment, are directly transferred to this critical roller ball bearing system, which is known in the industry to be very sensitive to wear and fatigue. Another disadvantage of this integrated roller bearing system is that the inner diameter due to the fabrication limitations, is limited to a maximum dimension of only about 8 meters, so that it not suitable for large disconnectable turret-buoy systems which comprise for example 20 or more risers connected to the buoy.

Another patent publication that describes a disconnectable mooring system that is provided with two separate bearing systems, one of which is used only for rotating a turntable in order to align the manifold pipe ends with the riser ends of a connected buoy, is U.S. Pat. No. 5,651,708. This patent shows a disconnectable buoy that is provided with a bearing system, which stays with the boy after it is disconnected. The buoy is rotatably connected to the moonpool of a vessel under the waterline without the use of a turret. An additional upper bearing system is disclosed at deck level, which supports a turntable with manifold, so that after the buoy is connected directly to the moonpool of the vessel, the turntable can be aligned with the risers of the connected buoy. The turntable is supported by the bearing system, so that even during production when hydrocarbons are received through the flexible piping connecting the manifold and the buoy, the turntable can be rotated at all times and be aligned with the buoy. When the twisting angle in the flexible piping between the buoy and the turntable is exceeded, the turntable is rotated by means of a connected motor driven pinion to a new position neutralizing the twisting. This system is therefore not suitable for disconnectable turret-buoy systems sized to receive larger numbers of risers, and cannot be used when using only hard piping to connect the risers and manifold.

It is therefore an object of the present invention to provide a rapidly disconnectable and easy connectable mooring buoy system that is able to support a large numbers of risers, for example at least 20 risers and 10 umbilicals. It is a further object of the present invention to provide a turret mooring system that is reliable in operation and provides a better distribution of forces on the bearing and hence reduces the risk of down time by maintenance activities. The mooring buoy system of the present invention should readily connect and disconnect even under severe environmental conditions to a floating vessel, for example a floating production unit (FPU or FPSO). The present invention can be applied for a disconnectable turret mooring system that will be permanently integrated towards the bow of a Floating Production Unit (FPU). The system allows the vessel to passively weathervane around the anchor legs and to take up the position of least resistance to the prevailing weather, while simultaneously transferring fluids, gas, power, and communications signals between the FPU and the subsea equipment. The system's design incorporates a disconnection/reconnection capability to allow the FPU vessel to disconnect from its anchoring system when for instance iceberg warnings are issued.

SUMMARY OF THE INVENTION

Hereto, a vessel according to the invention comprises a hull, a shaft extending from an upper part of the hull to a bottom of the hull, a turret being rotatably supported in the shaft via a turret bearing, a manifold support structure carrying one or more conduits being rotatably supported on the turret via a manifold bearing, the turret comprising a cavity for receiving a mooring buoy carrying one or more risers and one or more vertically displaceable actuation members near the manifold bearing for vertically displacing the manifold support structure relative to the turret between a rotational position in which the bearing support structure can rotate relative to the turret via the bearing members and a locked position in which the bearing support structure is rotationally locked relative to the turret.

According to the present invention, there are two separate bearing assemblies, preferably near or at deck level of the vessel. The first bearing assembly is the turret bearing system that could for instance consist of a large diameter upper bogie bearing system (with or without radial guiding wheels) and optionally a lower radial low friction pad bearing system to connect the turret rotatably to the moonpool of the vessel. The use of bogie wheel bearings allows for large diameter turrets and consequently allows for a large diameter mooring buoy to be connected to this turret.

The second bearing assembly according to the invention is situated between the turntable with manifold and the turret, allowing for independent rotation of the turntable with regard to the turret and the connected mooring buoy, so that fluid lines of both the manifold and the mooring buoy can be aligned after the buoy is connected to the turret. This procedure is very important as in severe conditions it is needed to connect the buoy as quickly as possible to the turret without first aligning the fluid line ends of the buoy and turret, as this is a very time consuming operation. This second bearing system or turntable bearing system is not directly connected to the turret bearing system but placed at a radial and preferably an axial distance from the turret bearing system, so that specific forces and moments are taken up by each specific bearing. The turntable bearing system is preferably a bogie wheel bearing system.

Because the turntable bearing system supports the turntable only temporarily in a rotary manner during the alignment of the piping ends on the manifold and buoy and supports the turntable directly onto the turret in a non-rotating manner in all other situations, such as during production of hydrocarbons from the wells via the risers and connected piping, the turntable bearing is not subject to large forces, resulting in reduced wear and fatigue-related defects.

Providing a separate turret and turntable bearing assembly in accordance with the invention has several advantages because the design of each bearing assembly can be optimised for its specific function. An additional advantage is that the maintenance and repair activities for these two bearing systems now becomes easier as each bearing system can be inspected, maintained and repaired independently, keeping the other one in place and in function. Also when bogie wheel bearings are used, the wheels can be replaced under offshore conditions independently from each other while the bearing systems as such remain functional, which results in reduced costs while a safe functioning of the overall system is better controlled. The turntable bearing system is only used at the moment when the manifold pipe ends need to be aligned with those of the buoy connected to the turret, and is in fact a temporary bearing system; once the alignment procedure is completed this bearing system does not need to be active anymore and does not transfer any loads and moments during the hydrocarbon production process.

In order to place the manifold support structure into its rotational position, it may be lifted relative to the turret (and to the turret bearing) over a small distance in the axial direction via the displacement device, where after the bearing members of the manifold bearing are lowered into rotating contact with the turret. The displacement device then lowers the manifold support structure such that its weight is supported on the turret via the bearing members in a rotating manner. In the non-rotational position the manifold support structure may rest on the turret, while the bearing members are retracted to a non load-bearing position.

Alternatively, the manifold support structure may be placed in its non-rotational position by the displacement device lifting the manifold support structure such that the bearing members are disengaged from the turret, the displacement device supporting the manifold support structure in a non-rotating manner on the turret. The manifold support structure is brought into its rotational position by lowering the support structure such that it is supported on the turret via the bearing members in a rotating manner.

The displacement device for lifting the manifold support structure may comprise one or more hydraulic cylinders situated between the turret and the manifold support structure having a relatively small stroke, such as for instance a few mm. In case the bearing members of the manifold bearing are formed by bogie wheel bearings, the displacement device may be integrated with the bogie wheels of the bearing, wherein lowering the wheels from the support structure against the turret in an axial direction causes the manifold support structure to be lifted from the turret to its rotational position.

In one embodiment, the turret bearing is placed at an axial distance and a at a radial distance of at least 0.5 m from the manifold bearing, wherein a radial distance from a turret center line is larger for the turret bearing than for the manifold bearing. By placing the manifold bearing closer to the center line of the turret than the turret bearing and at an axial distance above or below the turret bearing, the forces acting on the manifold bearing while aligning the manifold and connected conduits on the turret with the riser couplings on the buoy, can be effectively decoupled form the forces acting on the turret bearing. The diameter of the turret bearing may range from for instance 15 to 30 m or more, whereas the diameter of the manifold bearing may be at least 1 m smaller. Rotation of the manifold support structure may be effected by a drive member, such one or more electrical motors, hydraulic drive members or any other suitable actuator.

In a preferred embodiment, at least the turret bearing comprises a bogie wheel bearing. The bogie wheel bearing of the turret allows for constructing a large diameter turret comprising a large number of risers. Maintenance on one or more wheels of the bogie wheel bearing can be carried out under offshore conditions while the turret remains operational. The manifold bearing may be comprised of an axial-radial precision bearing with forged or segmented raceways, having a diameter not larger than about 8 m, but preferably is a bogie wheel type bearing.

In one embodiment the vessel according to the invention comprises a lifting device that is placed on the hull with a cable that extends through the cavity to a weight that is situated below a bottom of the vessel, a mooring buoy being attached to the cable, the mooring buoy carrying mooring lines that are connected to a sea bed and being receivable in the cavity for coupling with the vessel, the mooring buoy comprising a central shaft through which the cable passes, the buoy being movable relative to the cable in a length direction of the cable, which weight is located on the cable at or below the buoy, a stopper being provided on the cable for engaging with the buoy and for blocking relative movement of the buoy and the cable, the stopper being fixed to the cable near an upper or a lower end of the buoy.

The weight added to the buoy will cause the buoy to sink to a specific predetermined depth below the water surface upon disconnection from the vessel, for instance upon approach of an iceberg in ice-infested waters. Lifting the buoy towards the vessel is carried out via hauling in the weight suspended from the cable while allowing the buoy to rise by its own buoyancy towards the cavity for connection. By lifting only the weight that is suspended from the buoy without exerting a direct puling force on the buoy, the buoy will rise to the surface due to its own buoyancy once the weight is lifted from the buoy via the hauling in the cable connected to a winch on the vessel. This causes the buoy to slide along the hauling in cable that only functions as a guide element for the buoy while it rises. When the mooring buoy rises, the vertical motions of the buoy can be controlled and restrained by a stopper/spring assembly that is fixed to the hauling-in cable. This system allows to reduce the loads on the cable under heavy sea states and allows large size riser buoys carrying a large number of risers an mooring lines to be lifted by a winch an cable of limited size.

BRIEF DESCRIPTION OF THE DRAWINGS

Some embodiments of a vessel comprising a disconnectable turret mooring system according to the invention will be explained in detail with reference to the accompanying drawings. In the drawings.

DETAILED DESCRIPTION OF THE INVENTION

Figure 1:
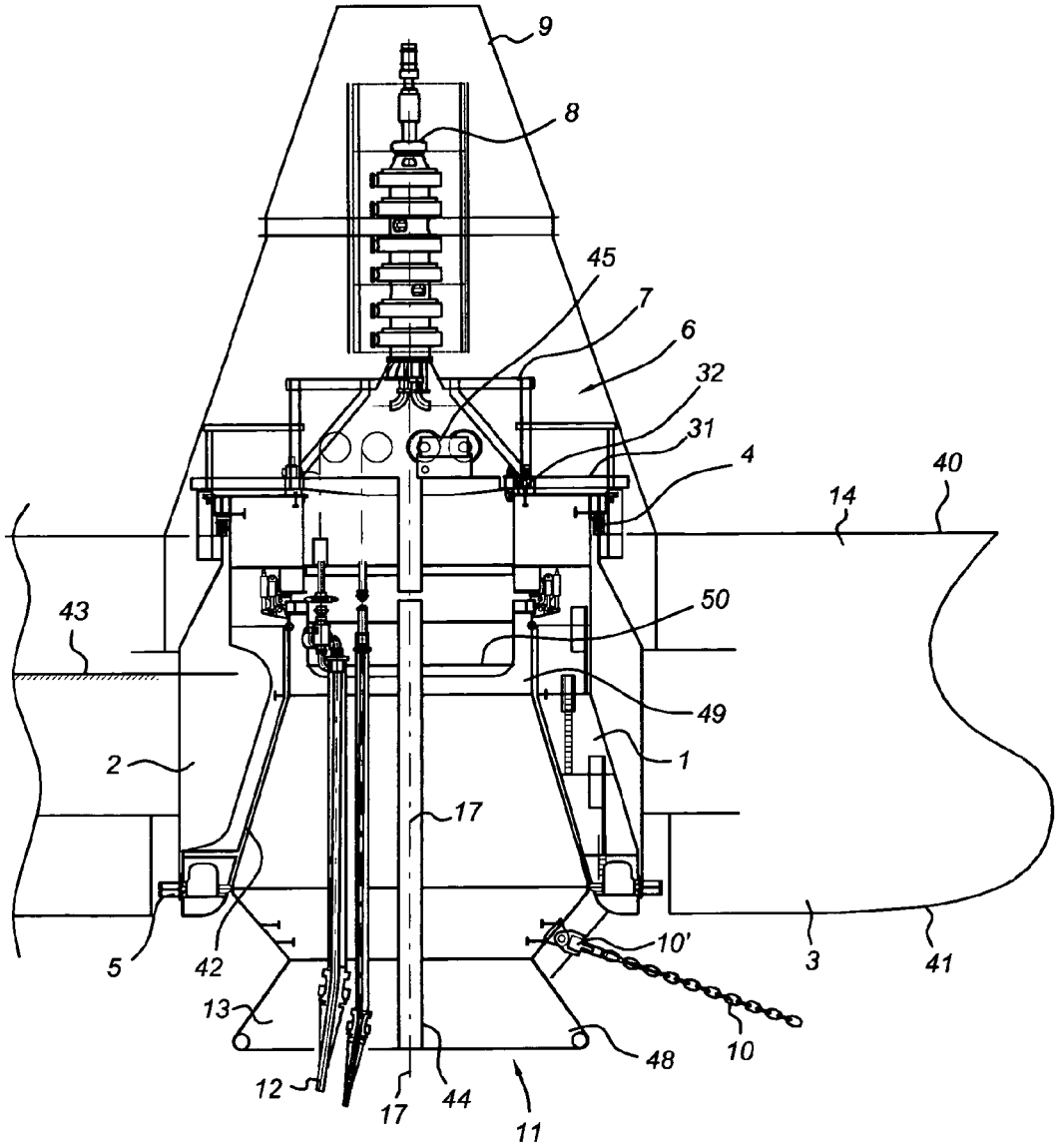
FIG. 1 shows a sectional view of a disconnectable turret mooring system according to the present invention.

FIG. 1 shows a sectional view of a disconnectable turret mooring system according to the present invention. The system comprises a cylindrical turret structure 1 located within a cylindrical moonpool 2 integrated into the hull 3 of a vessel 14 which for example could be a FPU or FPSO. A turret bearing system 4 connecting and aligning the turret to the moonpool of the vessel, comprises a large diameter top bogie bearing situated near deck level 40 and (optionally) a bottom low friction pad radial bearing 5, situated near bottom 41 of the hull 3.

A large multi-deck superstructure 6 is located on top of the turret 1 and houses installation and production equipment, piping manifolds 7 and the fluid/gas swivel stack 8 for incoming production fluids, exported fluids and control/chemical umbilicals.

Figure 3:
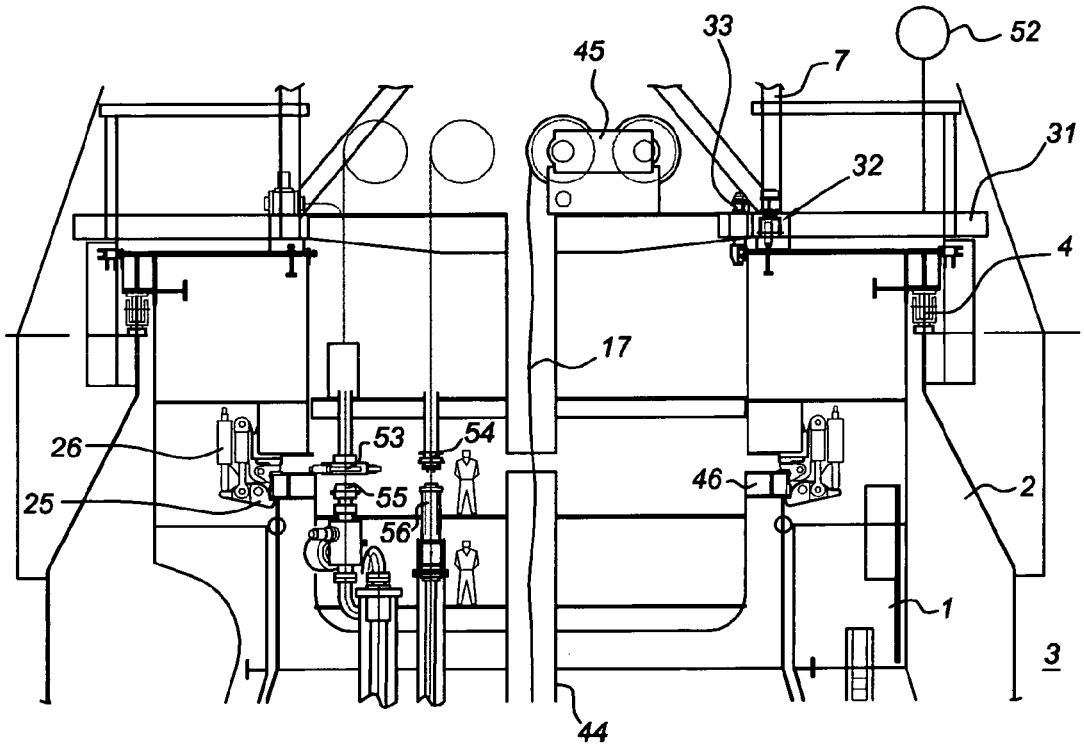
FIG. 3 shows an enlarged detail of the upper part of the turret mooring system including the turret bearing and the manifold bearing.

The manifolds 7 and swivel stack 8 are supported on a manifold support structure or turntable 31. The turntable 31 is rotatably supported on the turret 1 via a manifold bearing 32, as can be seen in FIG. 3. A steel framework 9 is positioned above and around the superstructure. The framework 9, which is connected to the vessel, supports the piping extending from the fluid swivel stack 8 to the FPU, provides access to the turret 1 from the vessel, drives the rotating part of the swivel and supports the wintering panels. The turret design allows for maintenance and repair in operation, which maximizes its availability over the full field design life.

A conical mooring buoy 11 is received into a cavity 42 near the bottom 41 of the hull 3 and is locked into the cavity 42 in a non-rotating manner. The buoy 11 is anchored to the sea bed via anchor legs 10 and carries risers 12 extending from a sub sea hydrocarbon well, such as production risers or umbilical risers.

The upper end of each anchor leg 10 is directly connected to a low friction articulated universal joint 10' on the hull of the buoy 11. When the mooring buoy 11 is connected to the vessel 14 or FPU, the buoy risers' deck 50 at a top part 49 of the buoy, is elevated above the maximum vessel draft level 43. This will ensure that in all conditions, all piping equipments are kept permanently dry to ease access and maintenance.

The mooring buoy 11 has two different functions. Firstly, when the vessel 14 is connected to the buoy 11, the buoy transfers the mooring loads of the anchor lines 10 which are connected to its outer shell. Secondly, when the vessel 14 is disconnected from the mooring buoy 11, the mooring buoy descends down to a depth at a predetermined distance below sea level and supports the anchor legs 10 and risers 12 at this submerged position. The pre-determined depth can for example be 30-50 meters below water level so that the disconnected buoy stabilizes under the wave active zone. In ice and iceberg infested waters the buoy 11 can be stabilized at a distance of even more than 100 m below water level to avoid any contact with icebergs.

The mooring buoy 11 comprises a stiffened cylindrical shell with watertight internal bulkheads which divide the buoy into compartments. The center of the buoy incorporates a thick walled inner cylinder 44 to house and guide a hauling in or connecting cable 17 that is attached to a winch 45. The top part of the buoy 11 is fitted with the annular connecting ring 46 on which the structural connector ratchets 26 that are placed within the turret, can be locked. I-tubes 47 are fitted in the center of the buoy for receiving risers and sub-sea umbilicals 12 and are terminated at a bottom end 48 in a flange to support the riser/umbilical bell-mouths. Risers bend stiffeners and bell-mouths are protected from ice drifting under the vessel hull by a conical skirt 13 at the bottom of the mooring buoy 11. Alternatively, there also can be protection means against ice like a skirt or fence placed at the bottom 3 of the vessel 14 to protect the moonpool 2 against ingress of ice when the vessel is disconnected from the buoy 11 or to protect the buoy 11 and risers 12 when the mooring buoy is connected to the turret.

Figure 2:
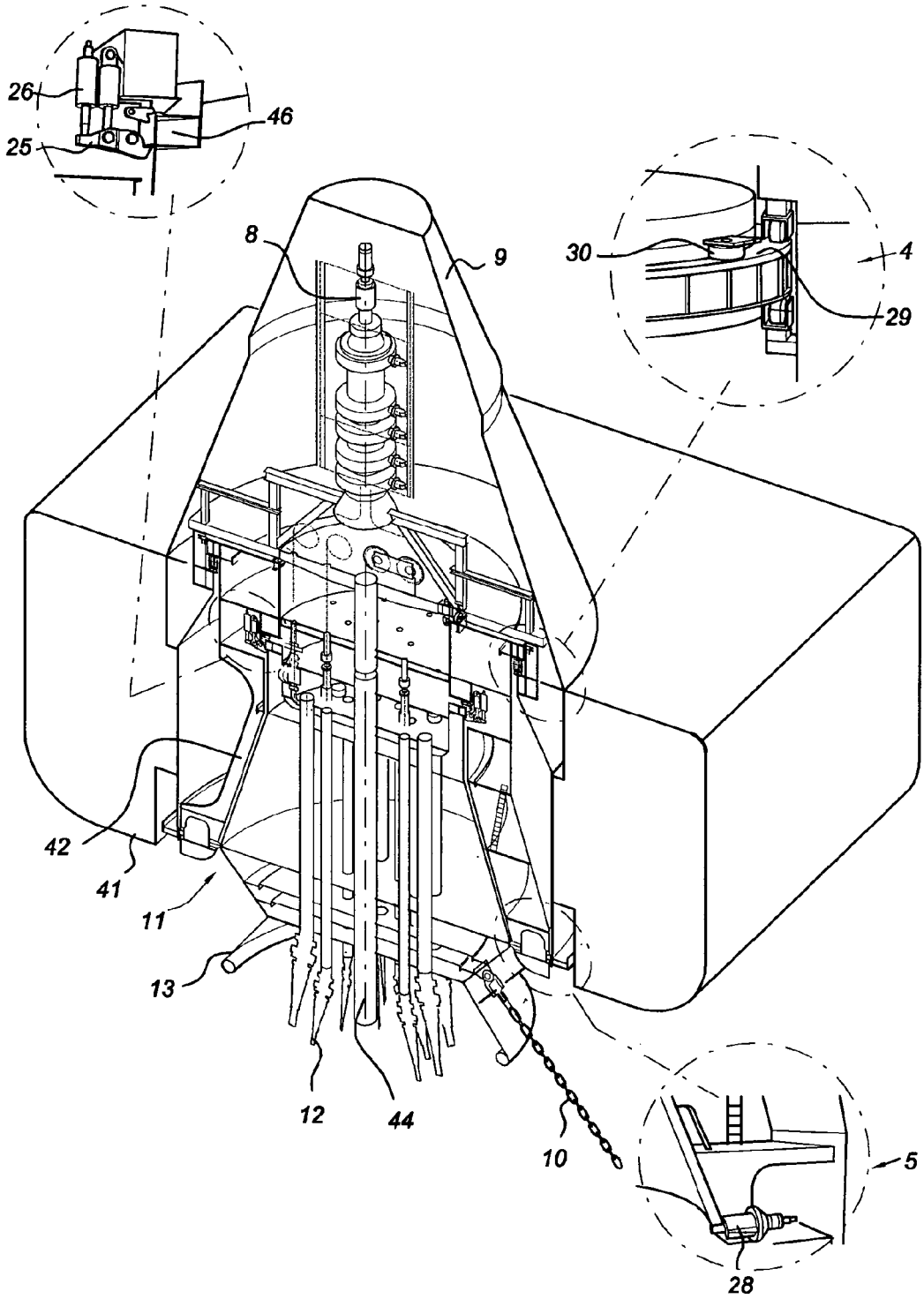
FIG. 2 shows a three-dimensional view of the system of FIG. 1.

The buoyancy required for keeping the buoy 11 supporting risers 12 and anchor legs 10 at the specified depth level in the disconnected state is provided by central compartments and compartments fitted on the buoy periphery, as can be seen from FIG. 2. The structural arrangement is such that it minimizes the contact between the buoy periphery and the turret parts during disconnection, so that there is no risk of accidental flooding. Nevertheless, the watertight buoy is compartmented in order to ensure sufficient buoyancy in case of accidental flooding of one compartment.

The connection and disconnection procedure of the mooring buoy 11 to the cavity 42 of the turret 1 shown in FIG. 1, is carried out as follows:

For reconnection, the vessel 14 will slowly approach the submerged mooring buoy 11 until a floating pick-up line that remains attached to the buoy can be grappled. Two sections of the hauling in line 17, of which the upper section is wound around the winch 45, are then shackled together and the pick-up line is removed. In case of reconnection in ice-covered waters, the connection of the hauling in line will be carried out directly in the dry part of the turret moonpool 2. In this situation, the vessel 14 is in effect moored to the submerged buoy. The traction winch 45 will be operated and the mooring buoy 11 is slowly lifted below the vessel 14 and into the cavity 42 of the moonpool 2 until the buoy top flange with connecting ring 46 will be in contact with a structural connector centralizer. The clamps 25 of the structural connector will be closed and mechanical locks are activated. The vessel 14 is now securely reconnected and moored via the turret 1 to the anchor legs 10 of the mooring buoy 11.

Next, the manifold support structure or turntable 31 will be unlocked and lifted over a small distance in the axial direction (e.g. over a distance of a few mm) via a hydraulic jack 33. The bearing members 32 are lowered such that they support the turntable 31 in a rotatable manner. Then a turntable orientation motor, schematically indicated at reference numeral 52, is started. By slowly rotating the turntable 31, the correct orientation of the manifold 7 will be achieved when manifold pipe ends 53,54 are brought in line with the mooring buoy riser ends 55,56. This operation is monitored from the control panel of the motor 52 and will in fact be controlled from the manifold lower deck. Once the correct turntable orientation has been achieved, the turntable 31 will be automatically locked and the temporary turntable bearing system 32 is deactivated by displacing the bearings 32 hydraulically upward in a vertical direction (e.g. over a distance of a mm) so that the lifted and orientated turntable 31 again comes to rest on the turret in a non-rotational manner. The flowlines, down stream their fluid connector that interconnects pipe ends 53, 54 and riser ends 55, 56, will be lowered back to their operating positions. The fluid connectors will be closed and leak tested. Once the isolation valves are opened production can recommence. The umbilicals are connected using a similar procedure.

As can be seen from FIG. 2, the rotational link between the weathervaning vessel 14 and the mooring buoy 11 comprises multiple sets of bogie wheels 4 for axial loads and radial wheels 30. This bearing system 4 is designed for both axial and radial loads.

The turret 1 shown in FIG. 2 consists of two main parts, a lower turret and an upper turret that includes the manifold decks for swivels, piping and equipment. The lower turret extends from near bottom level 41 to the upper bogie wheel bearing 4.

The lower turret is formed by a cylindrical/conical shell structure with ring stiffeners, designed to resist water and explosion pressures and prevailing mooring forces. The upper section of the lower turret structure provides the support for the bogie wheel bearing system 4 and consists of two subassemblies, the outer support structure connected to the vessel 14 via a cone and the inner support structure onto which the bogie rails 29 are bolted.

The weight of the turret 1 and the vertical loads from the anchor legs 10, risers 12, and umbilicals are transmitted through the upper bogie wheel bearing 4 and then via the bogie wheel bearing to the outer support structure mounted on the vessel moonpool 2.

Multiple structural connectors 25 of the clamping type establish the connection of the mooring buoy 11 to the turret 1. The structural connectors 25 are designed to transmit moments, vertical and horizontal loads. Hydraulic cylinders 26 drive the connectors 25 and the screw/motor-reductor system is used as mechanical locking system. Each connector can be individually activated when the buoy is connected for inspection, maintenance and repair.

Reconnection of the buoy 11 to the cavity 42 is achieved by lifting the mooring buoy 11 with the installation cable 17, which passes through the hollow steel guide piece 44 in the center of the manifold chamber 7. The mooring buoy 11 is connected without any specific attention as to its orientation. Only after the vessel 14 has safely been moored to the buoy 11, the turntable 31 with the complete turret manifold 7 is rotated to match the piping orientation on the buoy. The fact that the complete manifold 7 can be orientated with regard to the turret 1 will avoid performing the alignment of the manifold piping with the mooring buoy piping at the critical stage of the reconnection when the buoy 11 is supported from the connection winch 45 and is not yet securely moored to the turret 1.

The center of the turret 1 forms a receptacle for the mooring buoy 11 and is at the bottom terminated by a cylindrical hollow structure which holds the lower turret bearing assembly. This lower bearing assembly comprise of a set of low-friction bearing pads 5 made of self-lubricating material mounted on the lower turret outer box and radial stoppers 28. The bearings 5 are arranged in a radial pattern to resist the horizontal forces of the mooring system while permitting the turret 1 to rotate inside the moonpool 2. The pads are self oriented and can be inspected and removed in situ via the access in the lower turret.

FIG. 3 shows the upper bearing system 4 and the turntable bearing system 32 of the present invention in more detail. Reference number 31 shows the turntable that supports the upper turret manifold decks and swivel stack in a rotatable way. The turntable can be hydraulically lifted up (few mm) by means of a hydraulic jack 33 so that bearing system 32 can be activated and support the turntable on the turret in a rotatable way which is only needed for alignment of the manifold with the piping of the already connected buoy. To rotate the turntable 31 for alignment, the turntable motor drive system 52 is for example formed by a rack and pinion system of a type that is similar to known driving systems for turret rotation. This temporarily activated turntable bearing system 32 preferably comprises a bogie wheel bearing having at least 3 sets of hydraulically vertically displaceable bogie wheels, but can also comprise any other known bearing system including ball bearing systems, slide pads etc. After alignment, the turntable can again be lowered (by a few mm) onto the turret by deactivating the hydraulically vertically displaceable bogie wheels, and turntable 31 and turret can be locked and secured together in that position via hydraulic jacks 33.

Figure 4:
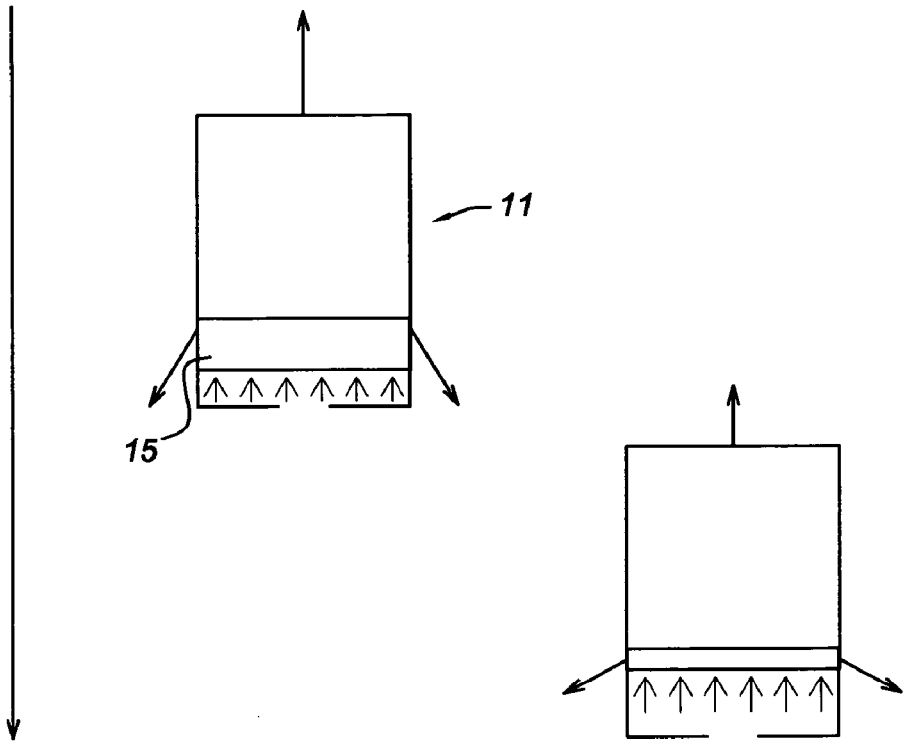
FIG. 4 shows a submerged mooring buoy with a soft buoyancy chamber according to one embodiment of the present invention, FIG. 5 schematically shows a submerged riser buoy during disconnection according to one embodiment of the present invention, FIG. 6 schematically shows the lifting of a submerged riser buoy according to one embodiment of the present invention.

FIG. 4 illustrates a subsea buoy 11 according to one embodiment of the present invention. The aim of the mooring system according to this embodiment is to ease the lifting of the submerged buoy 11, used as a disconnectable mooring system for a vessel 14, by fitting it with a variable buoyancy tank 15. The variable buoyancy function is achieved by the use of a compressible substance such as air, lighter than water and with a smaller bulk modulus. The substance contained in the tank 15 equalizes its pressure with the hydrostatic pressure either by direct contact (by being contained in a tank that is in open contact with the sea) or through a deformable membrane, air filled backs, a piston etc. Being more compressible than water, the volume of the substance, and therefore the displacement volume of the tank 15, depends on the depth at which the tank is located. The initial amount of substance to be placed in the tank 15 is determined as to fully or partially compensate for the anchoring/risers system variation of suspended weight with regards to depth. When the buoy is disconnected from the vessel and sinks, the hydrostatic pressure acting on the tank increases and the volume of the substance is reduced, as it is schematically illustrated in FIG. 4.

The buoyancy of the tank 15 becomes smaller and the buoy continues to sink until equilibrium is reached with the other vertical forces acting on the buoy (buoy weight, anchoring/risers system suspended weight).

When the buoy is lifted from its disconnected rest position, the pressure exerted on the substance decreases and the substance volume inflates, inducing more buoyancy and reducing the pulling effort required to lift the buoy and its anchoring/risers system.

Hence, the loads acting on the connection winch are reduced compared to conventional systems, allowing for reconnection of the mooring buoy with less dynamics and in higher sea-states.

A large pretension in the reconnection cable at reconnection is due to the variation in suspended chains/risers weight over the course of reconnection. This variation can be in the range of for instance 600 tons. Having a tank 15 with variable buoyancy in the buoy 11 according to the present invention allows to reconnect the buoy and to maintain the buoy in the connected state at a reduced pretension. The variation in suspended weight can therefore be compensated by the change in volume.

However, this variable buoyancy tank 15 fitted into the buoy 11 may not be sufficient to ensure the buoy will sink deep enough and fast enough for example to avoid an iceberg. The present invention therefore proposes also to attach a weight 16 via a cable 17 to the buoy 11.

Figure 5:
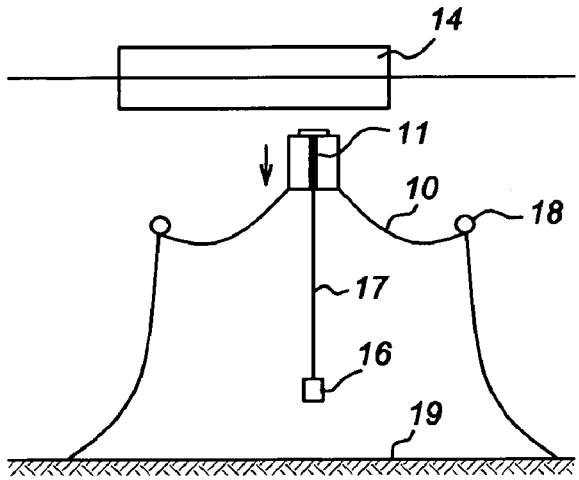

FIG. 5 illustrates the system during disconnection according to one embodiment of the present invention. The system according to the present invention is especially designed to be disconnected in the event of approach of an iceberg. Following a subsequent reconnection or, after the initial installation, the turret has to be prepared for a disconnection. When it is determined that the iceberg is on a direct course for the site and the decision is taken to disconnect, the flowlines will be flushed after which the valves upstream and downstream of the fluid connector will be closed. The short length of the piping downstream the fluid connector will be lifted after the upper connection point has been released in order to get clearance between the buoy and its receiving cavity in the turret. The umbilical will be simultaneously disconnected using a similar procedure. On the final decision to disconnect, the structural connector mechanical locks will be released and the structural connector will be opened. The mooring buoy 11 will then be released from the vessel and sink slowly to the predetermined water depth. The vessel can now sail away from the approaching iceberg and the buoy 11 placed at a sufficient depth (e.g. approximately 100 meters below the surface) to avoid contacting the iceberg.

In the embodiment shown in FIG. 5 everything is predetermined in such a way that the buoy is submerged at the desired depth, the buoyancy of the buoy 11, the mass of the weight 16 required underneath it at disconnection and the length of the cable 17. In the embodiment shown, the length of the cable 17 is adjusted so that the buoy 11 reaches its target depth when the weight 16 touches the seabed 19, although other embodiments are envisaged in which the weight 16 remains free from the seabed. This configuration guarantees an excellent stability in the disconnected state and the pretension in the connected state (with the weight attached) enables to drop the buoy within the short time allowed. In this configuration, the use of compressive tank 15 fitted within the buoy 11 can be maintained to adjust the buoyancy both in connected and disconnected condition.

Figure 6:
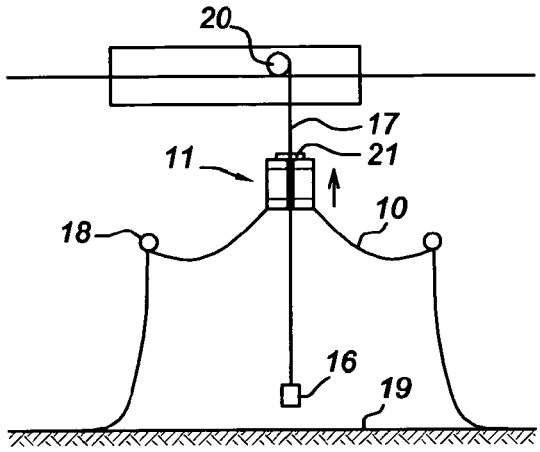

FIG. 6 shows the system during connection according to one embodiment of the present invention. A traction winch 20 is located on the centerline of the turret 1 on the manifold structure 7. The winch 20 is be used to haul in the buoy 11 inside the turret moonpool 2 during the reconnection. A storage winch can be located adjacent to the traction winch to receive the buoy reconnection line (not shown). The winch with associated sheave is also used for the hook-up of risers 12 and umbilicals.

To (re)connect the buoy 11, the weight 16 is lifted by the connection winch 20, instead of the buoy 11 as is done for conventional systems. By the effect of its positive buoyancy, the buoy 11 is free to rise by the same amount the weight 16 has been lifted. The "lift" of the buoy 11 is therefore controlled by the lift of the weight 16. In fact, the winch cable 17 lifts directly the pretension weight 16, while the buoy 11 slides along the cable 17. The vertical motions of the buoy are controlled and restrained by a stopper 21 fixed onto the winch cable 17. The contact between the stopper 21 and the buoy 11 is either direct (see FIG. 8*a*) or smoothened by springs 22 in order to ensure a smooth load transfer between the winch 20 and the buoy 11 as illustrated in FIGS. 8*b* to 8*d*.

Theoretically, hauling in the in the buoy 11 is approximately similar to only lifting the weight 16. When the vessel 14 heaves up, the weight 16 and the stopper 21 follow. The buoy is free to rise by means of its own positive buoyancy. When the vessel 14 goes down, the stopper 21 comes in contact with the buoy transferring the load of the winch 20 onto the buoy, controlling its lift. If the winch 20 becomes slack in the process, the peak load when the vessel goes up again is of limited amplitude because it is only restrained by the mass of the weight 16. The configurations in which the weight 16 is attached to the buoy 11 via spring members (FIGS. 8*b* to 86*d*) help limiting the amplitude of the snatch loads by transferring smoothly the loads between the winch 20 and the buoy 11. It can be shown that the "decoupling" becomes effective when the stiffness of the spring 22 is small compared to the winch cable 17. Sensitivity studies with regards to spring stiffness have shown that a ratio of 1/10 (i.e.~1000 kN/m for a winch cable of 10000 kN/m) is a workable order of magnitude.

By lifting only the relatively small pretension weight 16 during reconnection of the buoy 11, the present invention provides a very efficient way to reconnect a buoy having an important size carrying a relatively large number of risers and allows to use a main winch that has a lifting capacity that is comparable with that of drum winches that are known and available in the art.

The system according to the present invention can also be provided with spring buoys 18 to lighten the anchor legs 10 weight and that can also be used as "drop stoppers", to control the drop and stabilizing depth of the disconnected mooring buoy.

Another advantage of this system is that it decouples the buoys hydrodynamic from the winch loads, giving precedence to functional sizing over hydrodynamics optimization.

Figure 7A:
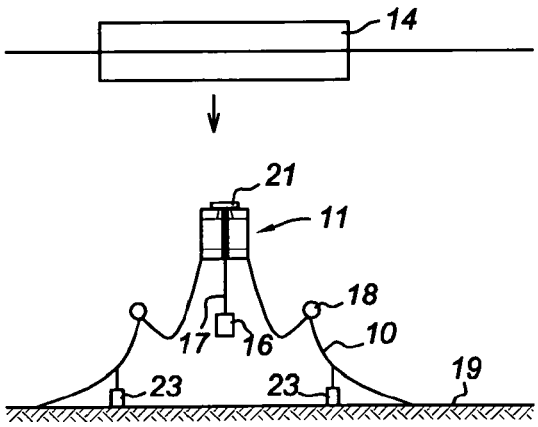
FIGS. 7*a* and 7*b* show alternative embodiments of the disconnection and connection of a submerged riser buoy according to the present invention.
Figure 7B:
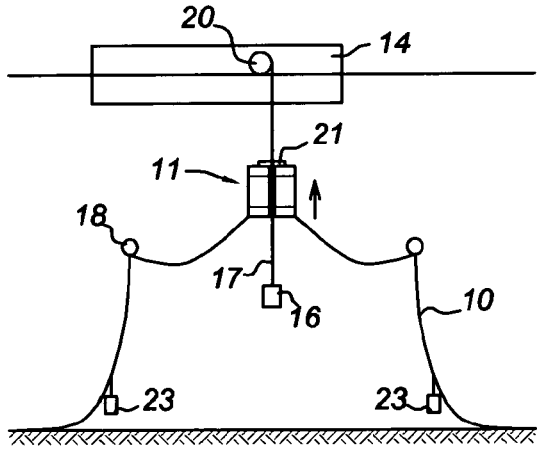

FIGS. 7*a* and 7*b* shows alternative embodiments of the disconnection/connection of the buoy 11 according to the present invention. The main difference over the known solutions is that it is not needed for the weight 16 to touch the sea bed 19 and to moor the disconnected riser buoy because in case of the invention the mooring buoy is already provided with mooring legs 10 that keep a disconnected buoy in place horizontally. The weight 16 is just to ease, control and simplify the connection and disconnection procedure of the mooring buoy. Additional weights 23 can be added on each mooring line 10 as is shown in FIGS. 7*a* and 7*b*. In this embodiment, the length of the cable 17 can be adjusted so that the buoy 11 reaches its target depth when weights 23 touch the seabed 19. This configuration guarantees the same advantages as the one shown in FIG. 5. The reconnection of the buoy 11 according to this embodiment is following the same procedure as shown in FIG. 6.

As stated earlier, FIGS. 8*a* to 8*e* show different embodiments of the disconnectable buoy with its associated pretensioned weight 16.

Figure 8A:
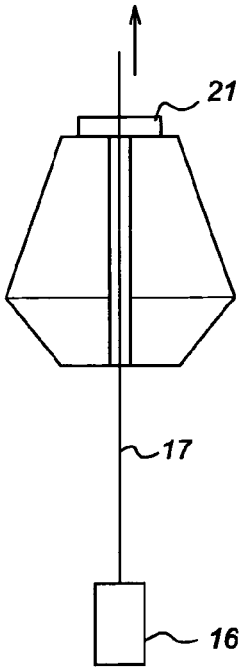
FIGS. 8*a* to 8*e* show different embodiments of a submerged riser buoy and associated weight according to the present invention.
Figure 8B:
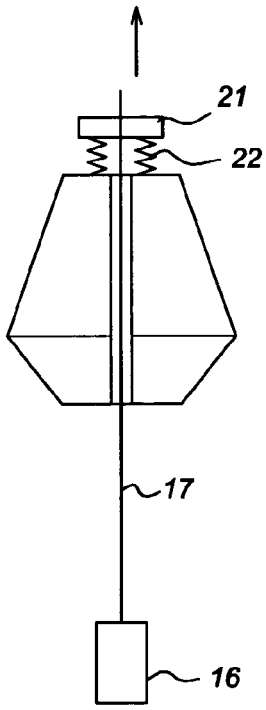
Figure 8C:
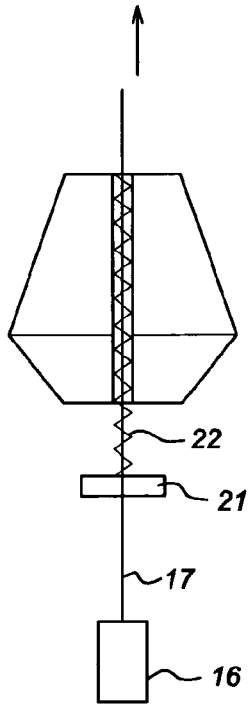
Figure 8D:
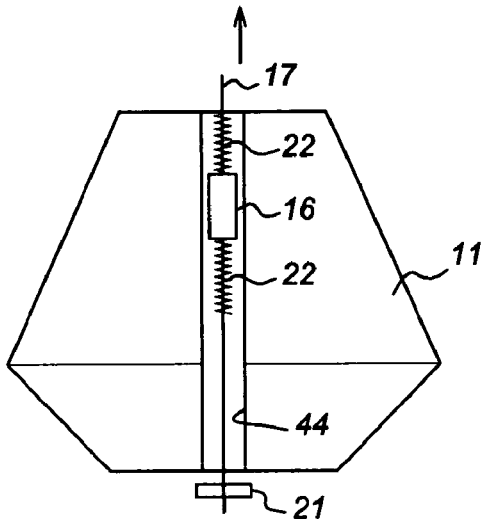
Figure 8E:
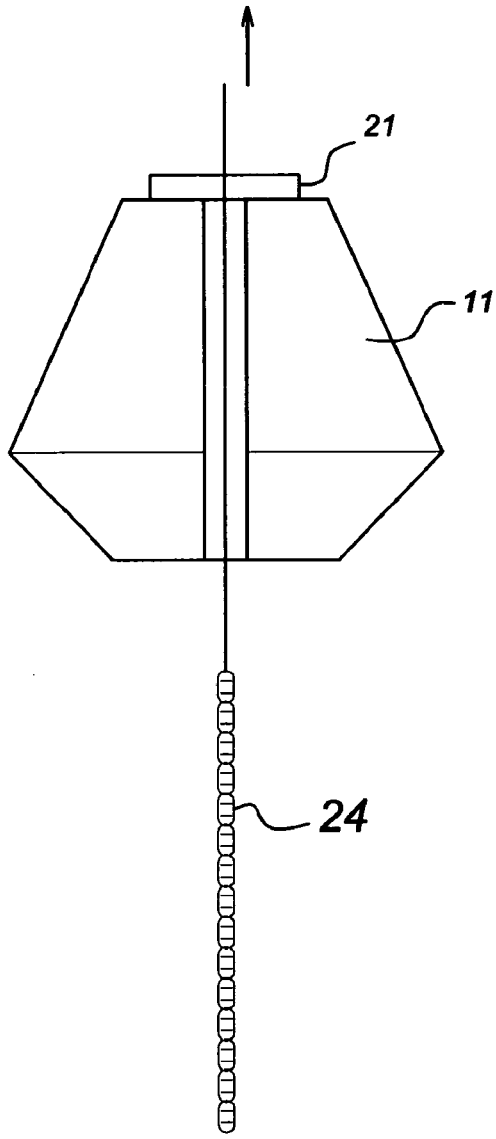

FIGS. 8*a* and 8*e* illustrate cases when the contact between the stopper 21 and the buoy 11 is direct. In FIG. 8*e* the weight 16 is suspended underneath the buoy 11 and has the form a long heavy chain 24. FIGS. 8*b* to 8*d* illustrate cases in which the contact between the stopper 21 and the buoy 11 is smoothened by springs 22 in order to ensure a smooth load transfer between the winch 20 and the buoy 11. In FIG. 8*b* the spring 22 is located at the top of the buoy 11, between the stopper 22 and the buoy 11. In FIG. 8*c* the spring is located within the buoy in the hollow passage where the cable 17 also passes through the buoy 11. In this configuration the stopper 21 is located underneath the buoy 11. In FIG. 8*d*, the weight 16 is not hanging underneath the buoy as illustrated in FIGS. 8*a*, 8*b*, 8*c* and 8*e*, but is located inside the buoy with spring means 21 above and underneath the weight, the stopper 21 being located underneath the buoy 11. These embodiments are not limitative and any combination of these shown embodiments could also be realized. For instance the embodiment shown in FIG. 8*e* could be modified by smoothening the contact between the stopper 21 and the buoy 11 by springs.

The invention claimed is:

1. Vessel (14) comprising a hull (3), a shaft (2) extending from an upper part (40) of the hull to a bottom (41) of the hull, a turret (1) being rotatably supported in the shaft via a turret bearing (4,5), a manifold support structure (31) carrying one or more conduits being rotatably supported on the turret via a manifold bearing (32), the turret comprising (1) a cavity (42) for receiving a mooring buoy (11) carrying one or more risers (12) and one or more vertically displaceable actuation members (33) near the manifold bearing (32) for vertically displacing the manifold support structure (31) relative to the turret (1) between a rotational position in which the manifold support structure (31) can rotate relative to the turret via the manifold bearing (32) and a locked position in which the bearing support structure (31) is rotationally locked relative to the turret.

2. Vessel (14) according to claim 1, wherein the turret bearing (4) is placed at an axial distance and a at a radial distance of at least 0.5 m from the manifold bearing (32), wherein a radial distance from a turret center line is larger for the turret bearing (4) than for the manifold bearing (32).

3. Vessel (14) according to claim 1, wherein the manifold bearing comprises bearing members that are displaceable in an axial direction relative to the bearing support structure (32).

4. Vessel (14) according to claim 1, wherein the manifold bearing (32) and/or the turret bearing (4) comprises a bogie wheel bearing.

5. Vessel (14) according to claim 1, comprising a drive member (52) for rotating the manifold support structure (31).

6. Vessel (14) according to claim 1, comprising a lifting device (20,45) that is placed on the hull with a cable (17) that extends through the cavity (42) to a weight (16) that is situated below the bottom (41) of the vessel, the mooring buoy (11) being attached to the cable (17), the mooring buoy carrying mooring lines (10) that are connected to a sea bed (19) and being receivable in the cavity (42) for coupling with the turret (1), the mooring buoy comprising a central shaft (44) through which the cable (17) passes, the buoy being movable relative to the cable (17) in a length direction of the cable, wherein the weight (16) is located on the cable at or below the buoy, a stopper (21) being provided on the cable for engaging with the buoy and for blocking relative movement of the buoy and the cable, the stopper being fixed to the cable near an upper or a lower end of the buoy.

7. Vessel (14) according to claim 6, wherein the buoy (11) comprises a buoyancy compartment (15) filled with a buoyancy material.

8. Vessel (14) according to claim 7 wherein the stopper (21) is attached to the buoy via a spring member (22).

9. Vessel (14) according to claim 6, wherein the buoy (11) is attached to the cable (17) via a spring member (22), the stopper (21) being situated below the buoy (11).

10. Vessel (14) according to claim 9, the weight (16) being situated at least partly inside the central shaft (44) of the buoy.

11. Vessel (14) according to claim 6, the weight (16) comprising a chain section.

12. Vessel (14) according to claim 1, comprising anchor legs (10) attached to the buoy (11) and to the seabed (19), each anchor leg being along its length attached to a floatation member (18).

13. Vessel (14) according to claim 1, the length of the cable (17) being such that in a disconnected state in which the buoy (11) is disconnected from the hull, the weight rests on the seabed (19).

14. Method of attaching a mooring buoy (11) comprising a number of risers (12) to a cavity (42) provided in a rotatable turret (1) near a bottom (41) of a hull (3) of a vessel (14), which turret is rotatably connected to the vessel via a turret bearing (4), the method comprising the steps of:

lifting a mooring buoy (11) towards the cavity by hauling in a line (17) that is attached to the mooring buoy (11) via a lifting device (20,45), the line extending through the turret to the lifting device, establishing a disconnectable mechanical connection between the mooring buoy (11) and the cavity (42) to connect the mooring buoy (11) to the cavity (42), providing a manifold (7) on a rotatable manifold turntable (31), which manifold turntable is supported on the turret in a non-rotating manner on a support surface, and comprises a manifold bearing (32), lifting the manifold turntable (31) in an axial direction to be free from the support surface and engaging the manifold bearing (32) with a bearing support surface on the turret, rotating a manifold support structure (31) to be aligned with the turret, de-activating the manifold bearing (32) and lowering the manifold turntable (31) onto the support surface, and establishing a fluid connection between riser ends (55,56) on the mooring buoy and the manifold (53,54) so that the mooring buoy (11) is attached to the vessel.

15. Vessel (14) according to claim 2, wherein the manifold bearing (32) and/or the turret bearing (4) comprises a bogie wheel bearing.

16. Vessel (14) according to claim 3, wherein the manifold bearing (32) and/or the turret bearing (4) comprises a bogie wheel bearing.

17. Vessel (14) according to claim 7, wherein the mooring buoy (11) is attached to the cable (17) via a spring member (22), the stopper (21) being situated below the mooring buoy (11).

18. Vessel (14) according to claim 8, wherein the mooring buoy (11) is attached to the cable (17) via a spring member (22), the stopper (21) being situated below the mooring buoy (11).

* * * * *